US006805405B2

(12) United States Patent
Koo

(10) Patent No.: US 6,805,405 B2
(45) Date of Patent: Oct. 19, 2004

(54) CHAIR EQUIPPED WITH LUMBAR SUPPORT UNIT

(75) Inventor: Yong-Seo Koo, Inchon (KR)

(73) Assignee: Sung Yong Co., Ltd., Inchon (KR)

( * ) Notice: Subject to any disclaimer, the term of this patent is extended or adjusted under 35 U.S.C. 154(b) by 0 days.

(21) Appl. No.: 10/076,847

(22) Filed: Feb. 12, 2002

(65) Prior Publication Data

US 2002/0130541 A1 Sep. 19, 2002

(30) Foreign Application Priority Data

Mar. 19, 2001 (KR) ..... 2001-7493
Mar. 19, 2001 (KR) ..... 2001-7495

(51) Int. Cl.[7] ..... A47C 3/025
(52) U.S. Cl. ..... 297/284.7; 297/284.4
(58) Field of Search ..... 297/284.4, 284.1, 297/452.1, 452.3, 354.1, 300.1, 284.7

(56) References Cited

U.S. PATENT DOCUMENTS 3,794,382 A * 2/1974 Bloomfield et al. ... 297/452.13
4,354,709 A * 10/1982 Schuster ..... 297/284.4
4,452,485 A * 6/1984 Schuster ..... 297/284.4
5,318,346 A * 6/1994 Roossien et al. ..... 297/300.1
5,474,358 A * 12/1995 Maeyaert ..... 297/284.7
5,518,294 A * 5/1996 Ligon et al. ..... 297/284.4
5,624,158 A * 4/1997 Adat et al. ..... 297/230.14
5,641,205 A * 6/1997 Schmidt ..... 297/284.7
5,664,841 A * 9/1997 Dal Monte ..... 297/408
5,735,574 A * 4/1998 Serber ..... 297/284.4
5,806,930 A * 9/1998 Knoblock ..... 297/300.1
5,902,011 A * 5/1999 Hand et al. ..... 297/284.6
5,944,382 A * 8/1999 Ambasz ..... 297/300.1
5,984,407 A * 11/1999 Ligon et al. ..... 297/284.4
6,045,185 A * 4/2000 Ligon et al. ..... 297/284.4
6,152,532 A * 11/2000 Cosentino ..... 297/284.4
6,227,618 B1 * 5/2001 Ligon et al. ..... 297/284.4
6,296,308 B1 * 10/2001 Cosentino et al. ..... 297/284.4
6,322,147 B1 * 11/2001 Leib ..... 297/452.19
6,425,637 B1 * 7/2002 Peterson ..... 297/452.3
6,430,801 B1 * 8/2002 Cosentino ..... 29/457
6,520,580 B1 * 2/2003 Hong ..... 297/284.4
6,536,840 B1 * 3/2003 Schuster et al. ..... 297/284.1

* cited by examiner

*Primary Examiner*—Peter M. Cuomo
*Assistant Examiner*—Stephanie Harris
(74) *Attorney, Agent, or Firm*—Schmeiser, Olsen & Watts

(57) ABSTRACT

A chair equipped with a lumbar support unit is disclosed. The lumbar support unit includes a lumbar plate attached to a lower portion of a tiltable backrest part, and an actuating connector comprising a connecting wire which is connected at one end to an upper end of the lumbar plate and is connected at the other end to a chair frame supporting the seat and back parts, and a connecting tube surrounding the connecting wire, which is positioned at one end at a location downwardly spaced from the one end of the connecting wire, and is connected at the other end to a movable frame. The lumbar plate is automatically protruded forward to snugly support a lumbar region of a user when the back part is tilted rearwardly. The chair can afford convenient operation and protection of a lumbar region of a user.

8 Claims, 8 Drawing Sheets

CHAIR EQUIPPED WITH LUMBAR SUPPORT UNIT

BACKGROUND OF THE INVENTION

1. Field of the Invention

The present invention relates to a chair, and more particularly to a chair equipped with a lumbar support unit in which the lumbar support unit attached to a lower portion of a backrest part is automatically protruded or bulged forwardly to snugly support a lumbar region of a user when the backrest part is tilted rearwardly, and restored to its normal position when the backrest part is erected, thereby affording convenient operation and protection of a lumbar region of a user.

2. Description of the Prior Art

In general, a chair, which is equipped with a backrest adapted to be tilted rearwardly when a user inclines the backrest rearwardly to take a rest, and to be restored to its normal position when the user erects his/her upper body to work, is widely used. In chairs including seats and backrests which are integrally operated as well as such chairs having tilting backrests, when a user stretches his/her upper body rearwardly, a backrest is tilted rearwardly by the rearward movement of the upper body. In the stretched position, since there is left a space between the lumbar region of the user and the chair without an additional lumbar support portion, the user cannot take comfortable rest. Even though there is an additional lumbar support part provided on a backrest, a user must manipulate a handle to operate the additional lumbar support part into a desired position regardless of tilting and restoring operations of the chair. Accordingly, the chair is inconvenient to users.

SUMMARY OF THE INVENTION

Accordingly, the present invention has been made keeping in mind the above problems occurring in the prior art, and an object of the present invention is to provide a chair equipped with a lumbar support unit which is adapted to be automatically protruded depending on an inclination of the chair to more comfortably support a lumbar region and thus spine of an user, thereby providing the user with improved convenience, comfortable rest and health enhancement.

It is another object of the present invention to provide a chair equipped with a lumbar support unit, which can be controlled in its protruding degree by a user.

It is still another object of the present invention to provide a chair equipped with a lumbar support unit, which is adapted to be easily operated.

In order to accomplish the above objects, the present invention provides a chair equipped with a lumbar support unit, in which the lumbar support unit includes a lumbar plate attached to a lower portion of a tiltable backrest part, and an actuating connector comprising a connecting wire which is connected at its one end to an upper end of the lumbar plate and is connected at its other end to a chair frame supporting the seat and back parts, and a connecting tube surrounding the connecting wire, which is positioned at one end at a location downwardly spaced from the one end of the connecting wire, and is connected at the other end to a movable frame.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

A chair equipped with a lumbar support unit according to the present invention will be described in further detail by way of example with reference to the accompanying drawings.

Figure 1:
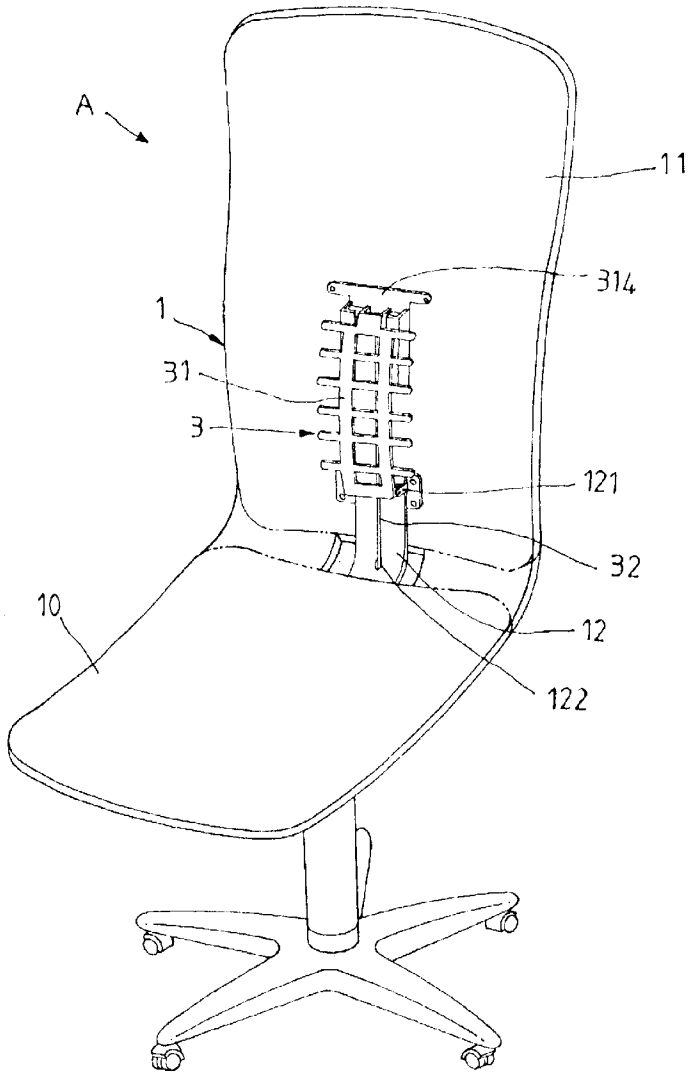
FIG. 1 is a schematic perspective view of a chair equipped with a lumbar support unit according to a first embodiment of the present invention.

Referring to FIG. 1, there is a chair "A" equipped with a lumbar support unit according to the present invention. As shown in the drawing, the chair "A" includes a L-shaped seat-back shell 1, which comprises a seat part 10, and a backrest part 11 integrally formed with the seat part 10. The seat-back shell 1 is joined to a known chair frame 2 to be tilted rearwardly. When a user inclines the seat-back shell 1 rearwardly so as to take a rest, the seat-back shell 1 is tilted into a proper rearwardly inclined position. On the other hand, when the user erects his/her upper body to work, the seat-back shell 1 is again restored to a normal position by elastic force of a spring (not shown). The backrest part 11 of the sea-back shell 1 of the chair "A" according to the present invention is provided at its front and lower portion with the lumbar support unit 3, which is intended to be protruded forwardly when the seat-back shell 1 is tilted rearwardly, and to be resiliently retracted to a normal condition when the seat-back shell 1 is again restored to its normal position.

Although the seat-back shell 1 is shown to be comprised of the seat part 10 and the backrest part 11, which are integrally formed, the seat part 10 and the backrest part 11 may be formed separately from each other, as indicated by dotted lines in FIG. 1.

Figure 2:
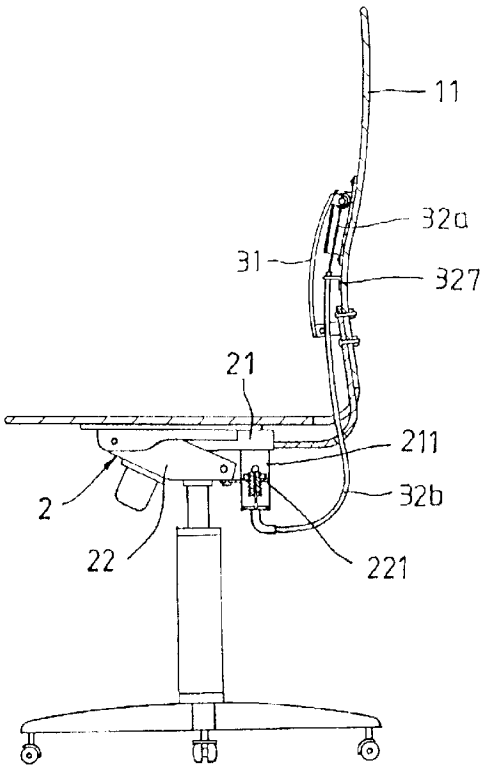
FIG. 2 is a schematic longitudinal cross-sectional view of the chair of FIG. 1.
Figure 3A:
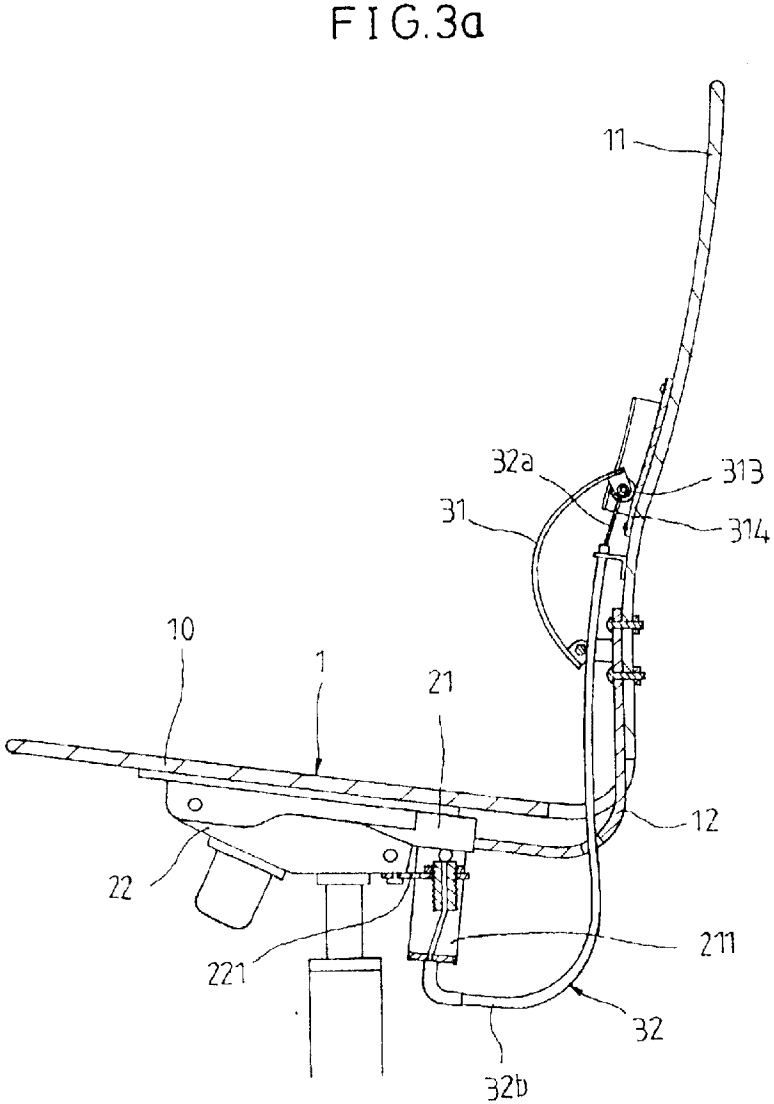
FIG. 3*a* is a cross-sectional view showing an operation of the lumbar support unit when a seat-back shell is tilted rearwardly.
Figure 3B:
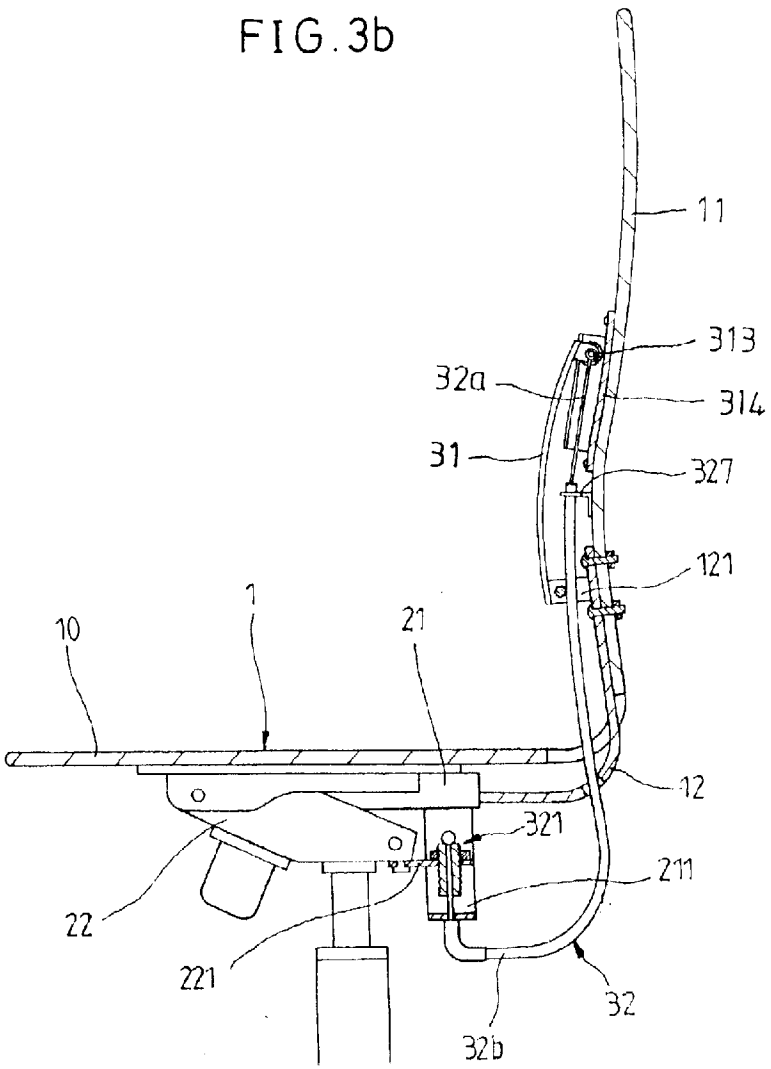
FIG. 3*b* is a cross-sectional view showing an operation of the lumbar support unit when a seat-back shell is restored to its normal position.

As shown in FIGS. 2 to 3*b*, the lumbar support unit 3 comprises a lumbar plate 31 attached to a lower portion of the backrest part 11 of the seat-back shell 1 which is adapted to resiliently bend or spread out, and an actuating connector 32 for actuating the lumbar plate 31 according to an operation of the seat-back shell 1, which is connected at its end to an upper end of the lumbar plate 31, extended downwardly and connected at the other end to the chair frame 2 to which the seat-back shell 1 is joined. The lumbar plate 31 is shaped by a leaf spring having excellent resilience. Although the lumbar plate 31 is shown to be naked showing its structure, the lumbar plate 31 is normally provided at its outer surface with a cover (not shown).

Figure 4:
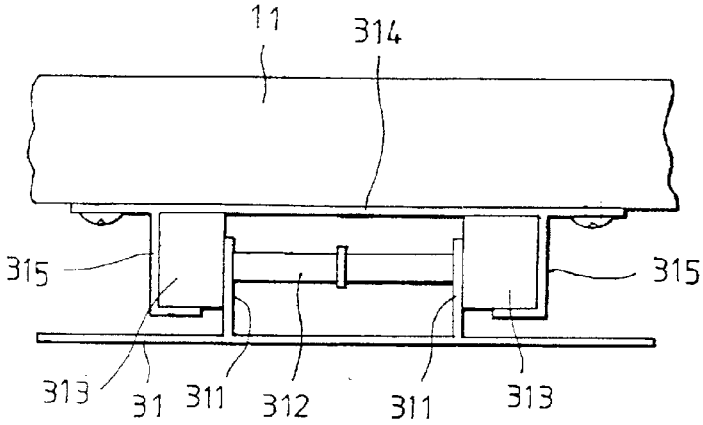
FIG. 4 is an enlarged cross-sectional view of an upper part of the lumbar support unit of FIG. 1.

Referring to FIG. 4, there is shown the lumbar support unit 3. As shown in the drawing, the lumbar plate 31 of the lumbar support unit 3 is provided at its upper end with a pair of angled brackets 311, which are extended toward the backrest part 11. A shaft 312 is rotatably supported by the pair of angled brackets 311, opposite ends of which are provided with rollers 313 so that the lumbar plate 31 can be smoothly slid upward and downward. The rollers 313 are slidably guided by a pair of guide rails 315, which are formed at a rail plate 314 attached to the backrest part 11 and longitudinally extended. The lumbar plate 31 is connected at its lower end to a hinge bracket 121 of a support frame 12 attached to the backrest part 11, and is slidably guided by the rail plate 314 at its upper end.

The support frame 12 is formed at its middle portion with a through hole 122 through which the actuating connector 32 passes, and is coupled at its lower end to a movable frame 21 of the chair frame 2.

The actuating connector 32 comprises a connecting wire 32*a* which is connected at upper end to the shaft 312 of the lumbar plate 31 and connected at the lower end to a fixed plate 221 rearwardly extended from a fixed frame 22 to which the movable frame 21 of the chair frame 2 is hingedly coupled, and a flexible connecting tube 32*b* into which the connecting wire 32*a* is extended, and which is fixed at its upper end to the backrest part 11 via a holding bracket 327 such that the upper end of the connecting tube 32*b* is positioned at a location somewhat spaced from the upper end of the connecting wire 32*a* and is positioned at its lower end adjacent to an actuating plate 211 of the movable frame 21.

The connecting wire 32*a* of the fixed plate 221 is provided at its lower end with wire control means 321, which is capable of controlling a protruding degree of the lumbar plate 31 by increasing or decreasing a length of the connecting wire 32*a*.

Figure 5:
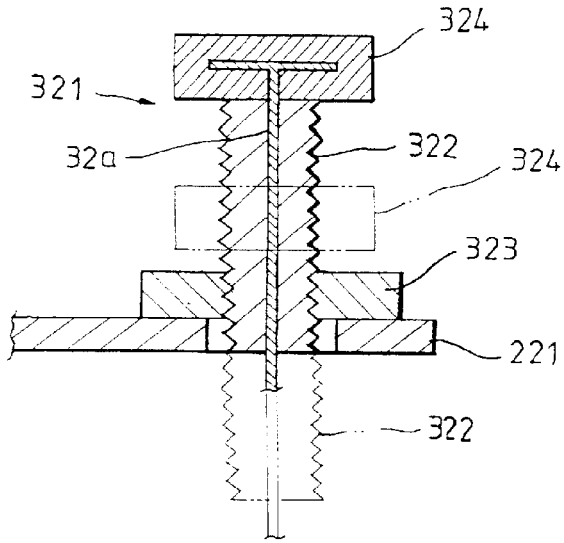
FIG. 5 is a cross-sectional view of wire control means coupled to an end of a connecting wire.

As shown in FIG. 5, the wire control means 321 comprises an adjusting bolt 322 integrally formed with the lower end of the connecting wire 32*a*, and an adjusting nut 323 placed on the fixed plate 221, into which the adjusting bolt 322 is threaded. Although the adjusting bolt 322 is shown to be provided with a wire-fixing end 324, which is intended to grip the end of the connecting wire 32*a*, the wire-fixing end 324 can be omitted. With the aid of the wire control means 321, when the adjusting nut 323 is rotated to raise the adjusting bolt 322, a length of the connecting wire 32*a* between the fixed plate 221 and the upper end of the lumbar plate 31 is decreased by a length corresponding to a raised height of the adjusting bolt 322, thereby tightening the connecting wire 32*a* and thus causing the lumbar plate 31 to be resilienty bulged. Accordingly, since the lumbar plate 31 is protruded from a retracted position when the backrest part 11 is tilted rearwardly, the protruded lumbar plate 31 is further resiliently bulged. In contrast, when the adjusting bolt 322 is lowered by the reverse rotation of the adjusting nut 323, a length of the connecting wire 32*a* between the fixed plate 221 and the upper end of the lumbar plate 31 is increased by a length corresponding to a lowered height of the adjusting bolt 322, thereby loosening the connecting wire 32*a*. Therefore, the bulged lumbar plate 31 is somewhat reduced in a protruded degree.

The connecting wire 32*a* is passed through a through hole 211*a* of the actuating plate 211 and then fixed to the fixed plate 221 of the fixed frame 22. The lower end of the connecting tube 32*b* is fixed to a lower surface of the actuating plate 211. The upper end of the connecting wire 32*a*, which is fixed to the lumbar plate 31, is positioned to be spaced from the upper end of the connecting tube 32*b* by a certain exposed distance "L" in its uppermost position. It is preferable that the exposed distance "L" of the connecting wire 32*a* is equal to or longer than a vertical travel distance of the actuating plate 211 of the movable frame 21. If the exposed distance "L" of the connecting wire 32*a* is shorter than the vertical travel distance of the actuating plate 211, the connecting wire 32*a* is applied with excessive load, causing problems such as breaking of the wire.

Figure 6:
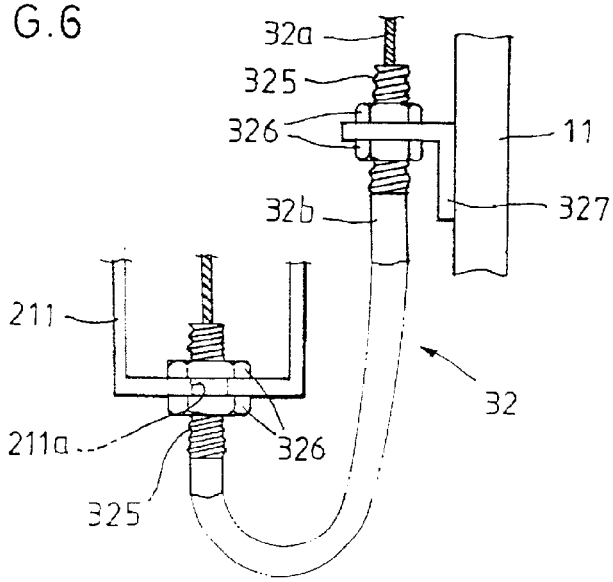
FIG. 6 is an enlarged view showing both ends of a connecting tube, which are locked.

As shown in FIG. 6, the lower end of the connecting tube 32*b* is coupled to the actuating plate 211 in such a way that the lower end of the connecting tube 32*b* is provided with a male threaded portion 325 and the male threaded portion 325 is threaded into two fastening nuts 326 with the actuating tube 211 between the two fastening nuts 326. On the other hand, the other upper end of the connecting tube 32*b* is coupled to the holding bracket 327 attached to the backrest part 11 in such a way that the upper end of the connecting tube 32*b* is formed with a male threaded portion 325 and the male threaded portion 325 is threaded into two fastening nuts 326 with the holding bracket 327 between the two fastening nuts 326.

Operations of the chair "A" according to the present invention will now be described. As shown in FIG. 3*a*, when a user inclines the seat-back shell 1 rearwardly to take a rest, both the seat part 10 and the backrest 11 are tilted concurrently. At this point, since the movable frame 21, on which the seat part 10 is mounted, is inclined downwardly at its rear portion and thus the actuating plate 211 attached to the rear portion of the movable frame 21 is lowered while pushing the lower end of the connecting tube 32*b* of the actuating connector 32, the connecting wire 32*a* is drawn with respect to the lower end of the connecting tube 32*b*, thereby downwardly pulling the upper end of the lumbar plate 31 to which the upper end of the connecting wire 32*a* is connected. Accordingly, as the upper end of the lumbar plate 31 is pulled down by the tensioned connecting wire 32*a*, the elastic lumbar plate 31 is protruded or bulged forward while the rollers 313 move along the guide rails 315 of the rail plate 314, thereby snugly supporting a lumbar region of a user. The bulging motion of the lumbar plate 31 is halted and maintained in position when the tilting of the seat-back shell 1 is completed. As shown in FIG. 3*b*, when the seat-back shell 1 is returned to the normal position, the movable plate 211, which is in a state of pressing the connecting tube 32*b* of the actuating connector 32, is raised, so that the tensioned condition of the connecting wire 32*a* is released resulting in raising of the upper end of the connecting wire 32*a*. With the raising of the connecting wire 32*a*, the protruded lumbar plate 31 is spread out by its resilience and restored to the normal almost straight position while the rollers 313 of the lumbar plate 31 move upward along the guide rails 315.

Figure 7A:
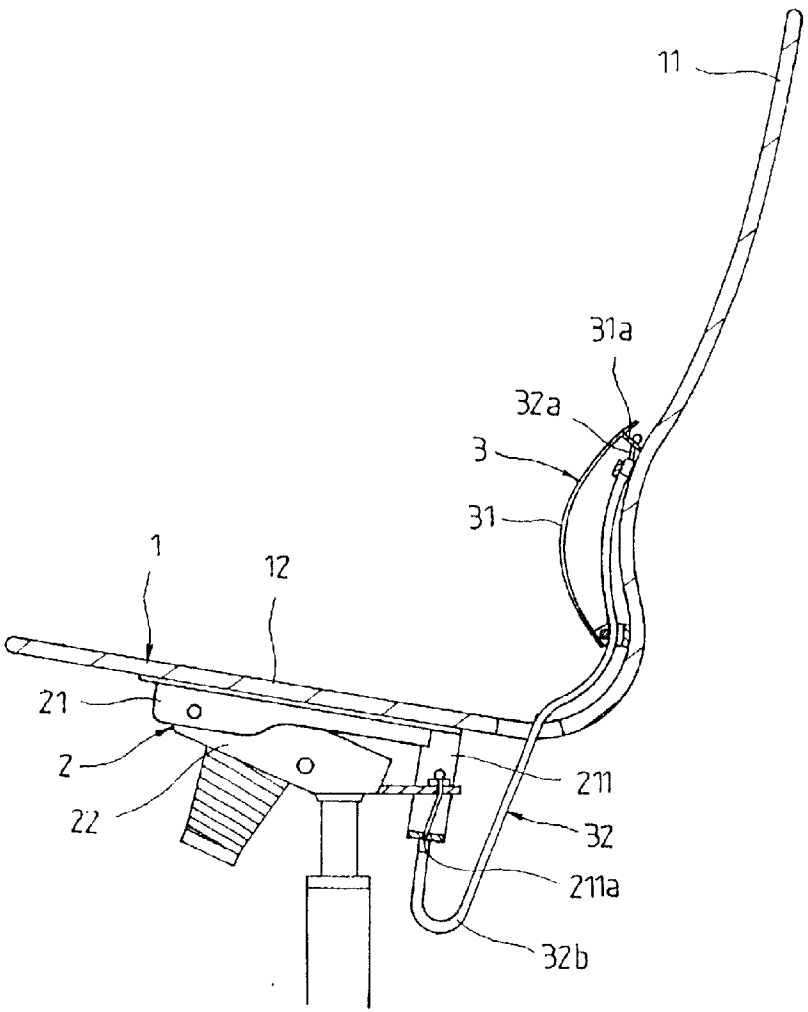
FIG. 7*a* is a cross-sectional view of a chair equipped with a lumbar support unit according to a second embodiment of the present invention, in which a seat-back shell is tilted rearwardly.
Figure 7B:
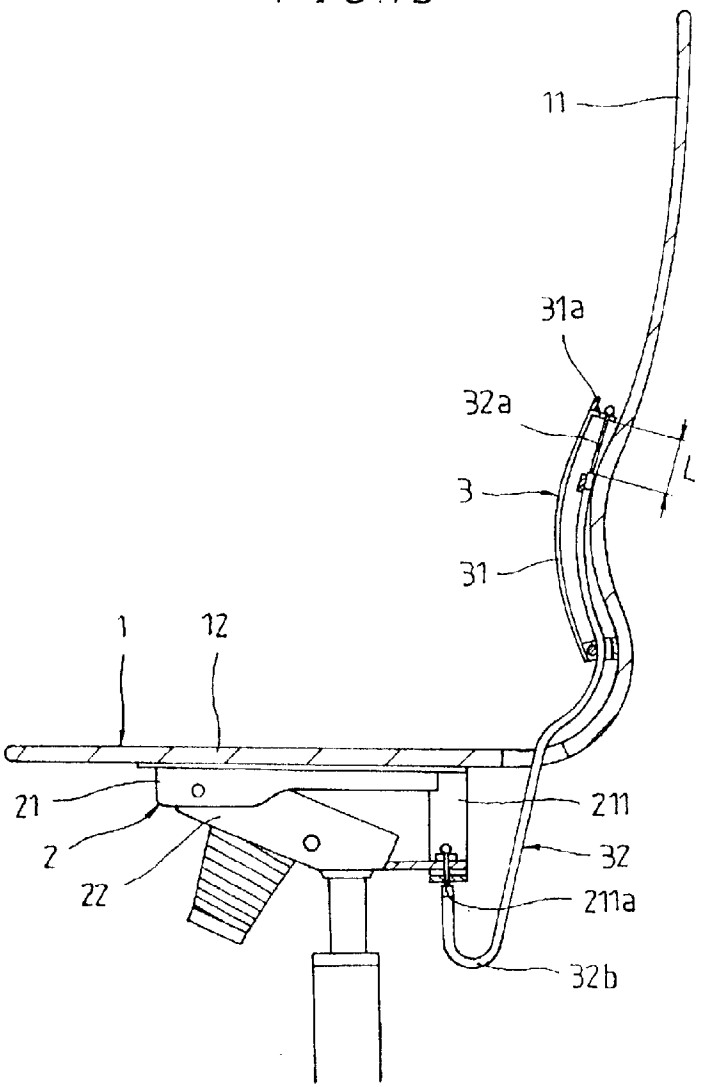
FIG. 7*b* is a similar view to FIG. 7*a*, in which the seat-back shell is restored.

FIGS. 7*a* and 7*b* show a chair "A" equipped with a lumbar support unit according to a second embodiment of the present invention, which is more simplified by omitting the rollers of the above-described first embodiment. In this embodiment, the lumbar plate 31 is protruded forward when the seat-back shell 1 is tilted rearwardly, and restored to its normal position when the seat-back shell 1 is again erected to be upright, as in the first embodiment.

Figure 8A:
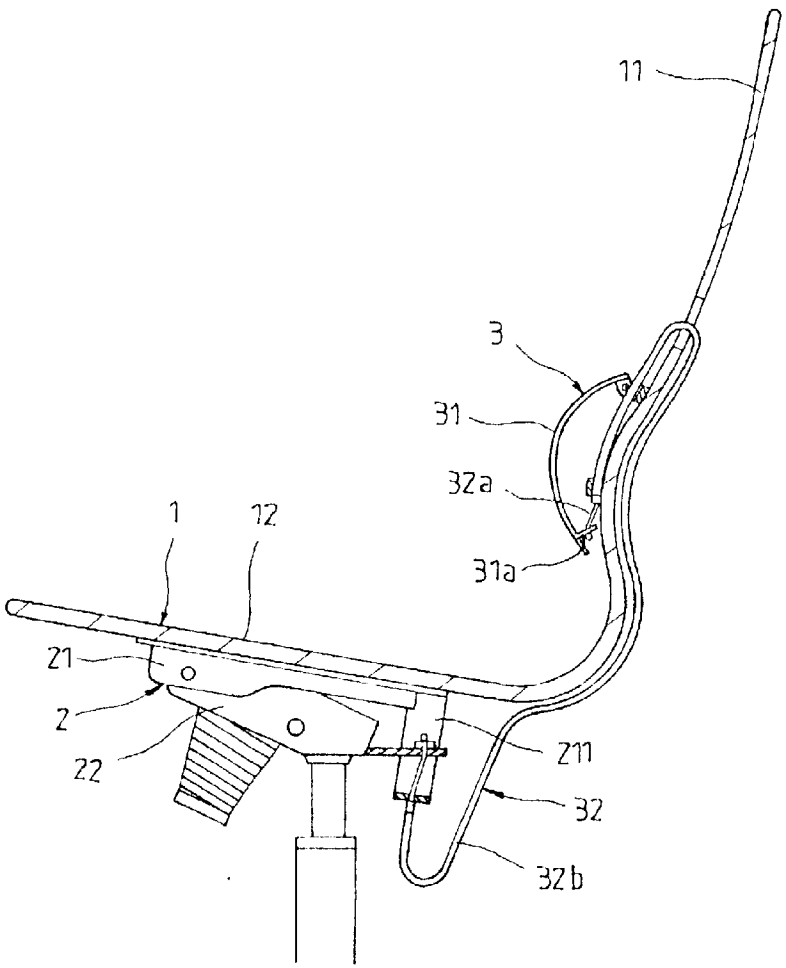
FIG. 8*a* is a cross-sectional view of a chair equipped with a lumbar support unit according to a third embodiment of the present invention, in which a seat-back shell is tilted rearwardly.
Figure 8B:
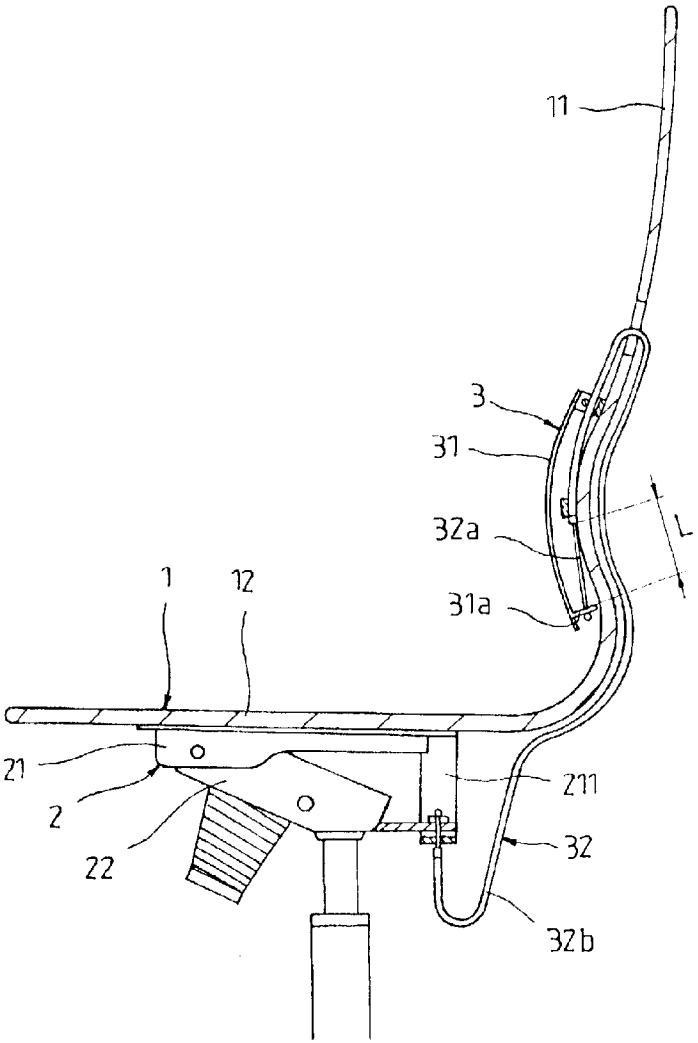
FIG. 8*b* is a similar view to FIG. 8*a*, in which the seat-back shell is restored.

FIGS. 8*a* and 8*b* show a chair "A" equipped with a lumbar support unit according to a third embodiment of the present invention. In this embodiment, the connecting wire 32*a* of the actuating connector 32 is connected at its upper end to the lower end of the lumbar plate 31. From the lower end of the lumbar plate 31, the connecting wire 32*a* is upwardly extended and then curved downwardly through a hole of the backrest part 11. When the seat-back shell 1 is tilted rearwardly by an upper body of a user, the movable frame 21, on which the seat part 10 is mounted, is downwardly inclined at its rear portion. Hence, the actuating plate 211 attached to the rear portion of the movable frame 21 is lowered while pushing the lower end of the connecting tube 32*b* of the actuating connector 32, so that the connecting wire 32*a* is drawn with respect to the lower end of the connecting tube 32*b*, thereby upwardly pulling the lower end of the lumbar plate 31 to which the upper end of the connecting wire 32*a* is connected. Accordingly, as the lower end of the lumbar plate 31 is pulled up by the drawn connecting wire 32*a*, the elastic lumbar plate 31 is protruded forward, thereby snugly supporting a lumbar region of a user. The bulging motion of the lumbar plate 31 is halted and maintained in the position when the tilting of the seat-back shell 1 is completed. On the other hand, when the seat-back shell 1 is returned to the normal position, the movable plate 211, which is in state of pressing the connecting tube 32*b* of the actuating connector 32, is raised, so that the tensioned condition of the connecting wire 32*a* is released. Therefore, the protruded lumbar plate 31 is spread out by its resilience and restored to the normal almost straight position.

Figure 9:
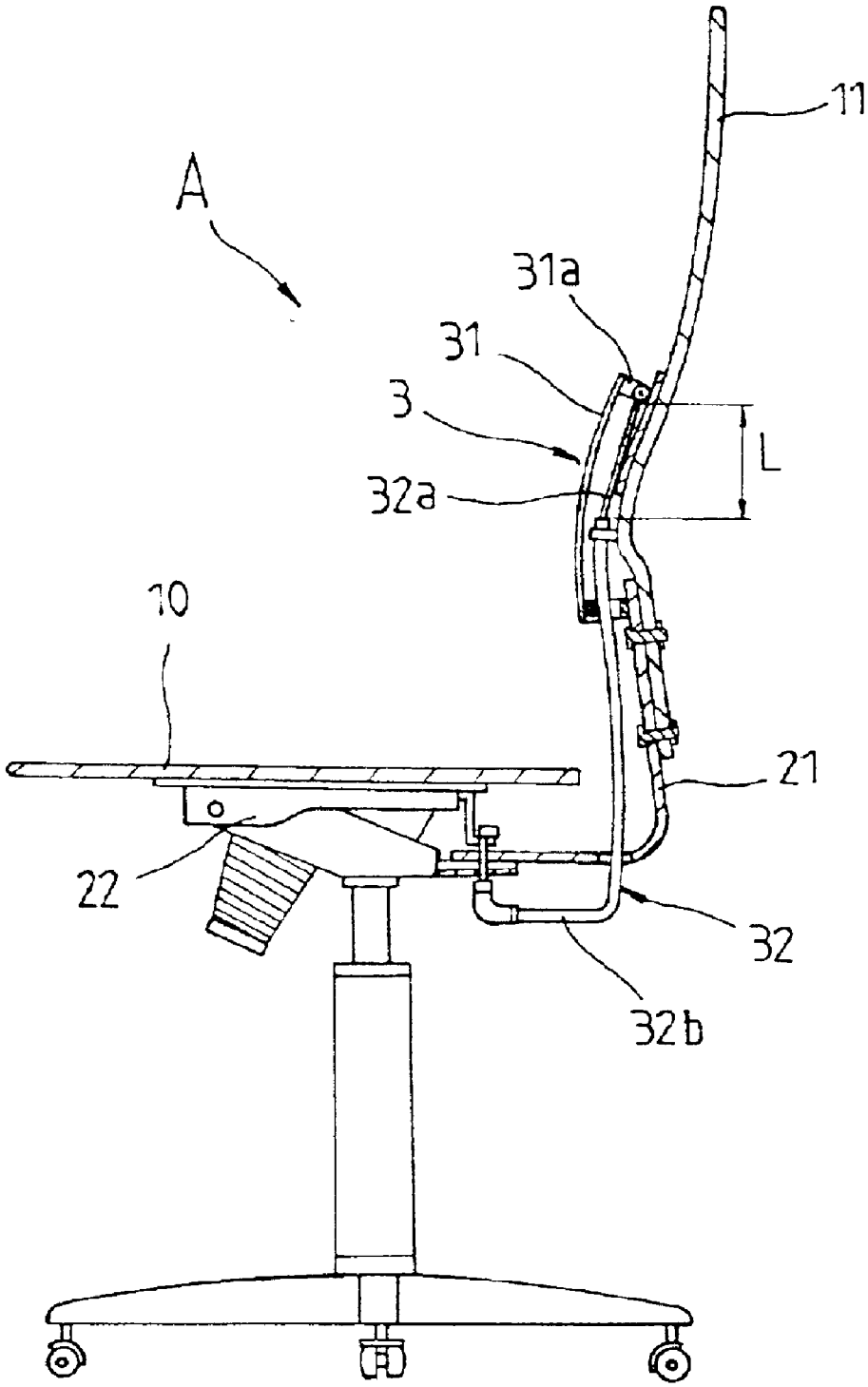
FIG. 9 is a cross-sectional view of a chair equipped with a lumbar support unit according to a fourth embodiment of the present invention.
Figure 10A:
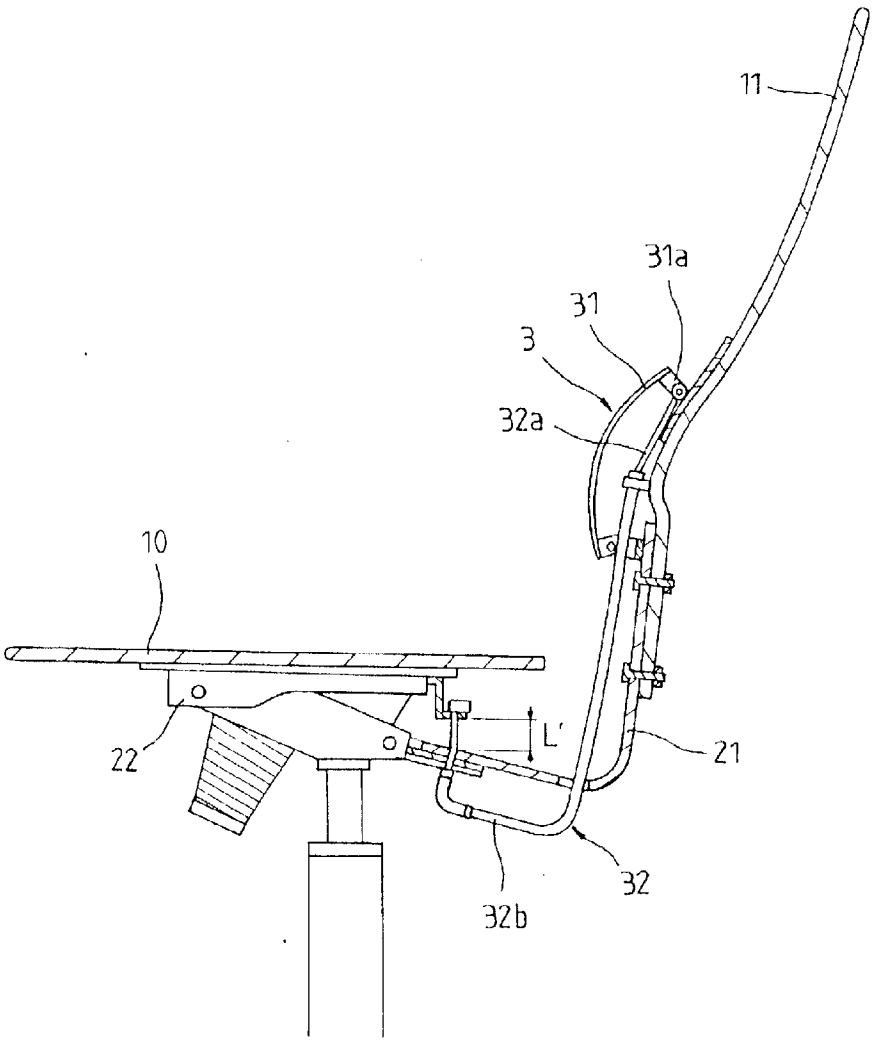
FIG. 10*a* is a cross-sectional view showing an operation of the lumbar support unit of FIG. 9, in which a movable frame is tilted rearwardly.
Figure 10B:
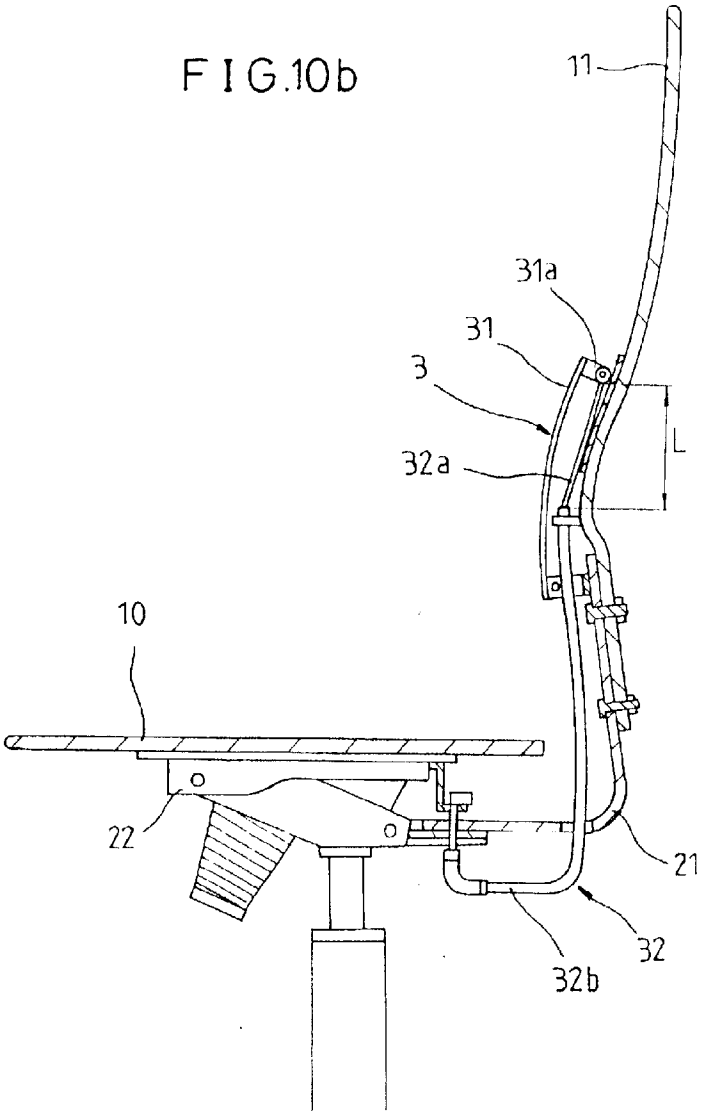
FIG. 10*b* is a similar view to FIG. 10*a*, in which a movable frame is restored.

FIG. 9 shows a chair "A" equipped with a lumbar support unit according to a fourth embodiment of the present embodiment, which is provided with a fixed seat part and a tiltable backrest part which are formed separately from each other. The fixed frame 22, on which the seat part 10 is mounted, is provided with the movable frame 21 which is hingedly connected thereto at its front end. The movable frame 21 is attached with the separate backrest part 11. The backrest part 11 is provided at its lower portion with the lumbar support unit 3, which is adapted to be protruded forwardly when the movable frame 21 is inclined, and is resiliently restored to its normal position when the movable frame 21 is again erected upright.

The lumbar support unit 3 comprises a lumbar plate 31 attached to the lower portion of the elastic backrest part 11, which can be bulged forwardly, and an actuating connector 32 for causing the lumbar plate 31 to be protruded and spread out according to motion of the movable frame 2, which is connected at its upper end to the upper end 31*a* of the lumbar plate 31 and extended downwardly. The lower end of the actuating connector 32 is connected to the movable frame 22, to which the movable frame 2 is hingedly connected.

The actuating connector 32 comprises a connecting wire 32*a* which is connected at its upper end to a upper end of the lumbar plate 31, and connected at its lower end to a fixed plate 22, and a flexible connecting tube 32*b* into which the connecting wire 32*a* is extended, and which is fixed at its upper end to the backrest part 11 such that the upper end of the connecting tube 32*b* is positioned at a location spaced from the upper end of the connecting wire 32*a* and is connected at its lower end to a lower portion of the movable frame 21 or the fixed frame 22. In this embodiment, the lower end of the connecting tube 32*b* is connected to the lower portion of the movable frame 21. Furthermore, although the actuating connector 32 is illustrated to be comprised of the connecting wire 32*a* and the connecting tube 32*b*, the actuating connector 32 may be comprised of only the connecting wire 32*a*.

The upper end of the connecting wire 32*a*, which is fixed to the lumbar plate 31, is positioned to be spaced from the upper end of the connecting tube 32*b* by a certain exposed distance "L" in a normal position. It is preferable that the exposed distance "L" of the connecting wire 32*a* is equal to or slightly longer than a maximum spacing "L'" defined between the fixed frame 22 and the movable frame 21 when the movable frame 21 is most inclined. If the exposed distance "L" of the connecting wire 32*a* is shorter than the maximum spacing "L", the connecting wire 32*a* is applied with excessive load, causing problems such as breaking of the wire 32*a*.

Operations of the chair "A" according to the fourth embodiment of the present invention will now be described. When a user inclines the backrest part 11 and thus the movable frame 21 rearwardly to take a rest, the movable frame 21, which is hingedly connected to fixed frame 22, is inclined downwardly to cause the spacing "L'" to be longer. At this point, the connecting wire 32*a* is drawn with respect to the lower end of the connecting tube 32*b*, thereby downwardly pulling the upper end of the lumbar plate 31. Accordingly, as the upper end of the lumbar plate 31 is pulled down by the connecting wire 32*a*, the elastic lumbar plate 31 is protruded or bulged forward, thereby snugly supporting a lumbar region of a user. The bulging motion of the lumbar plate 31 is halted and maintained in the position when the tilting of the backrest part 11 and thus the movable frame 21 is completed. When the movable frame 21 is returned to the normal position, the spacing "L'" is reduced, allowing the tensioned condition of the connecting wire 32*a* to be released. Therefore, the protruded lumbar plate 31 is spread by its resilience and restored to the normal position.

Figure 11A:
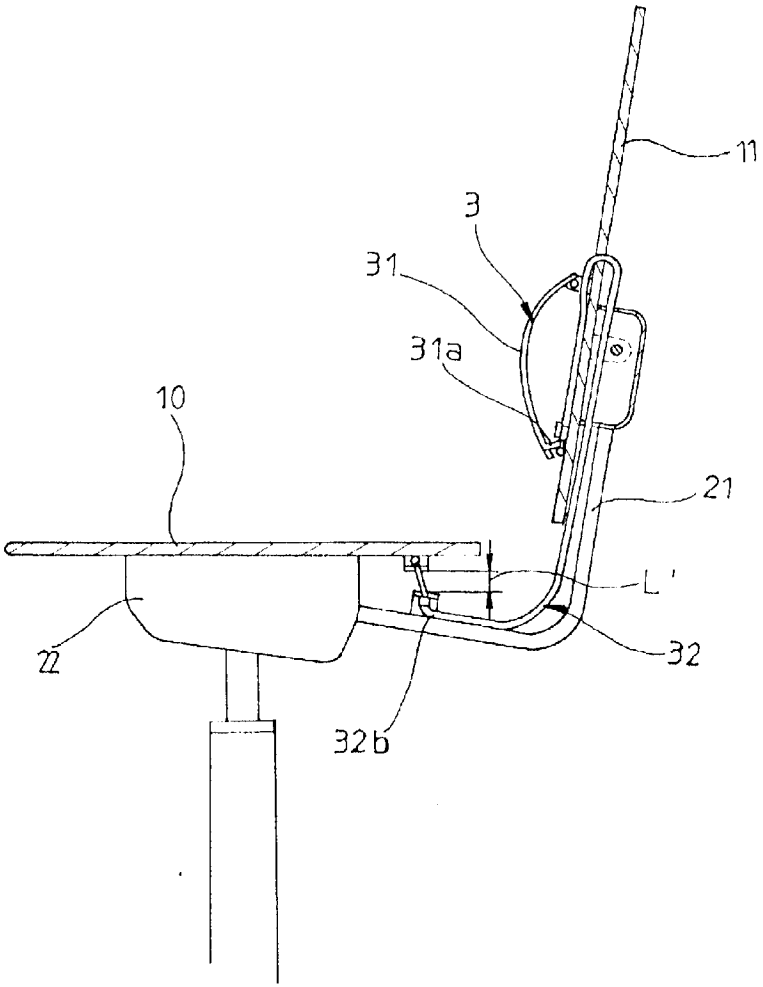
FIG. 11*a* is a cross-sectional view of a chair equipped with a lumbar support unit according to a fifth embodiment of the present invention, in which a movable frame is tilted.
Figure 11B:
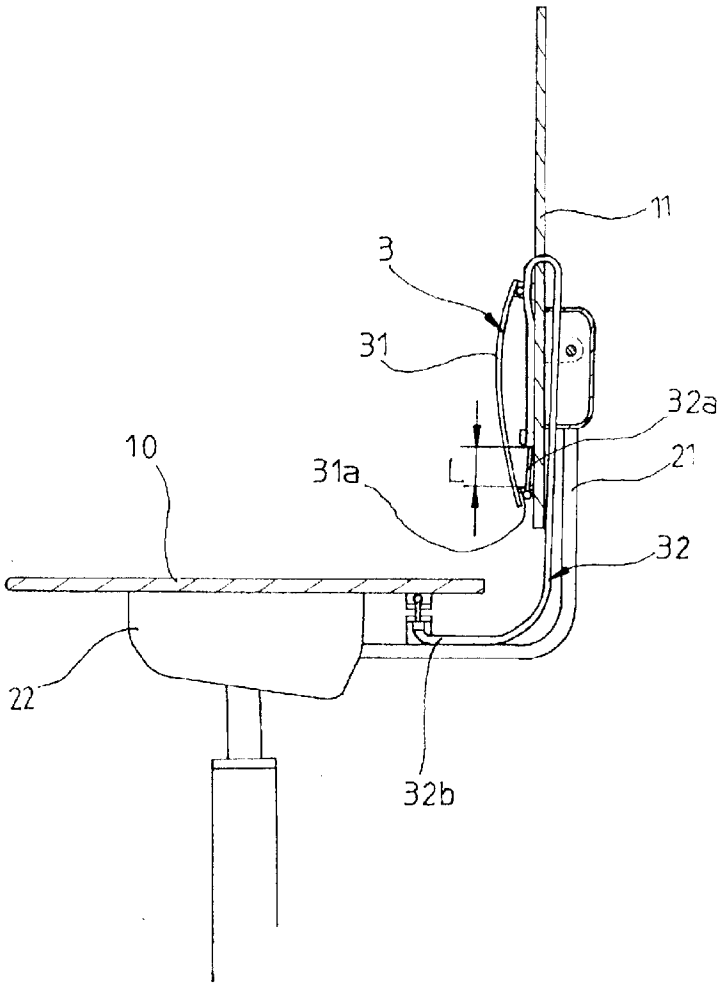
FIG. 11*b* is a similar view to FIG. 11*a*, in which a movable frame is restored.

FIGS. 11*a* and 11*b* show a chair "A" according to a fifth embodiment of the present invention, which is substantially similar to the chair of the fourth embodiment except that the upper end of the connecting wire 32*a* of the actuating connector 32 is connected to the lower end of the lumbar plate 31. In this embodiment, when a user inclines the backrest part 11 and thus the movable frame 21 rearwardly to take a rest, the movable frame 21, which is hingedly connected to fixed frame 22, is inclined downwardly to cause the spacing "L'" to be longer. At this point, since the upper end of the connecting wire 32*a* is drawn upwardly, pulling the lower end of the lumbar plate 31 upwardly, the elastic lumbar plate 31 is protruded or bulged forward, thereby snugly supporting a lumbar region of a user. The bulging motion of the lumbar plate 31 is halted and maintained in position when the tilting of the movable frame 21 is completed. When the movable frame 21 is returned to the normal position, the tensioned condition of the connecting wire 32*a* is released. Therefore, the protruded lumbar plate 31 is spread by its resilience and restored to the normal position.

As described above, the present invention provides a chair equipped with a lumbar support unit, in which the lumbar support unit is automatically protruded or bulged forwardly to snugly support a lumbar region of a user when a backrest part is tilted rearwardly, and restored to its normal position when the backrest part is erected. Accordingly, the chair of the present invention can afford convenient operation and protection of a lumbar region of a user.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A chair comprising:

a chair frame, said chair frame comprises a fixed frame having a fixed plate; and a movable frame hingedly connected to the fixed frame and having an actuating plate;

a seat-back member mounted on the chair frame, said seat-back member comprises a seat part and a backrest part which are integrally formed with each other, and which is adapted to be tilted rearwardly and restored to its normal position; and a lumbar support unit attached to a lower portion of the backrest part which is automatically protruded forwardly when the seat-back member is tilted rearwardly, and is resiliently restored to its normal position when the seat-back member is erected, said lumbar support unit comprises a lumbar plate which is hingedly connected at one end to the backrest part and is connected at the other cud to the backrest part to be slid up and down, and which is adapted to be protruded forwardly; and an actuating connector which is connected at one end to the lumbar plate and is connected at the ether end to the chair frame such that the actuating connector causes the lumbar plate to be protruded forwardly when the seat-back member is tilted rearwardly and is resiliently restored to its normal position when the seat-back member is erected, wherein said actuating connector comprises a connecting wire which is connected at one end to an upper end of the lumbar plate and is connected at the other end to the fixed plate of the fixed frame; and a connecting tube into which the connecting wire is extended, and which is connected at one end to the backrest part such that the one end of the connecting tube is positioned at a location downwardly spaced from the one end of the connecting wire, and is connected at the other end to the actuating plate of the movable frame, wherein the one end of the connecting wire, which is connected to the lumbar plate, is exposed from the one end of the connecting tube by a certain distance in its normal position, and the exposed distance of the connecting wire is equal to or longer than a distance by which the actuating plate moves downwardly.

2. The chair as set forth in claim 1, in which the chair frame comprises a fixed frame having a fixed plate, and a movable frame hingedly connected to the fixed frame and having an actuating plate, and the actuating connector comprises:

a connecting wire which is connected at one end to a lower end of the lumbar plate and is connected at the other end to the fixed plate of the fixed frame; and a connecting tube into which the connecting wire is extended, and which is connected at one end to the backrest part such that the one end of the connecting tube is positioned at a location upwardly spaced from the one end of the connecting wire, and is connected at the other end to the actuating plate of the movable frame.

3. The chair as set forth in claim 1, in which the lumbar support is provided at its upper end with an angled bracket extended toward the backrest part and supporting a shaft, both ends of which are provided with rollers moving up and down for the sake of smooth motion of the lumbar plate, and the backrest plate is provided a rail plate at a position corresponding to the lumbar support unit, the rail plate being provided at its both sides with guide rails extended downwardly, the rollers being slid up and down along the guide rails of the rail plate.

4. The chair as set forth in claim 1, in which the connecting wire is provided at one or both ends with wire control means for controlling lengths of the connecting wire exposed from the ends of the connecting tubes.

5. The chair as set forth in claim 4, in which the wire control means comprises a bolt integrally coupled to the end of the connecting wire, and a fastening nut disposed on the fixed plate and threaded with the male threaded portion of the connecting wire to control the exposed length of the connecting wire by its own rotation.

6. The chair as set forth in claim 1, in which one or both ends of a connecting tube of the actuating connector are formed at outer surfaces thereof with male threaded portions, and each of the threaded portion of the connecting tube is threaded into two nuts for fastening the male threaded portion.

7. The chair as set forth in claims 1, in which one or both ends of the connecting tube of the actuating connector are formed at outer surfaces thereof with male threaded portions, and each of the threaded portion of the connecting tube is threaded into two nuts for fastening the male threaded portion.

8. The chair as set form in claim 1, wherein said lumbar support unit is automatically protruded forwardly only when the seat-back member is tilted rearwardly, and is resiliently restored to its normal position only when the seat-back member is erected.

* * * * *